US007129893B2

(12) United States Patent
Otaka et al.

(10) Patent No.: US 7,129,893 B2
(45) Date of Patent: Oct. 31, 2006

(54) HIGH FREQUENCY ANTENNA MODULE

(75) Inventors: Naoki Otaka, Komaki (JP); Noriyasu Sugimoto, Konan (JP); Toshikatsu Takada, Konan (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 32 days.

(21) Appl. No.: 10/773,314

(22) Filed: Feb. 9, 2004

(65) Prior Publication Data

US 2004/0183729 A1 Sep. 23, 2004

(30) Foreign Application Priority Data

Feb. 7, 2003 (JP) ..... P2003-030915

(51) Int. Cl.
*H01Q 1/38* (2006.01)

(52) U.S. Cl. ..... 343/700 MS; 343/702

(58) Field of Classification Search ..... 343/700 MS, 343/702, 895, 700
See application file for complete search history.

(56) References Cited

U.S. PATENT DOCUMENTS

| | | | | |
|---|---|---|---|---|
| 6,023,251 | A * | 2/2000 | Koo et al. | 343/895 |
| 6,075,491 | A * | 6/2000 | Dakeya et al. | 343/722 |
| 6,222,489 | B1 * | 4/2001 | Tsuru et al. | 343/700 MS |
| 6,433,745 | B1 | 8/2002 | Nagumo et al. | |
| 6,650,303 | B1 * | 11/2003 | Kim et al. | 343/895 |
| 6,680,701 | B1 * | 1/2004 | Sung | 343/700 MS |
| 6,825,819 | B1 * | 11/2004 | Kim et al. | 343/895 |
| 2002/0149538 | A1 * | 10/2002 | Tomomatsu et al. | 343/895 |
| 2002/0163470 | A1 | 11/2002 | Nagumo et al. | |
| 2003/0107440 | A1 * | 6/2003 | Miki et al. | 330/297 |

FOREIGN PATENT DOCUMENTS

| | | |
|---|---|---|
| EP | 0 863 571 A2 | 9/1998 |
| EP | 1 168 658 A1 | 1/2002 |
| JP | 58134512 | 8/1983 |
| JP | 10-98322 | 4/1989 |
| JP | 2-68513 | 5/1990 |
| JP | 07-007321 | 1/1995 |
| JP | 9-55618 | 3/1997 |
| JP | 9-199939 | 7/1997 |
| JP | 11-4117 | 1/1999 |
| JP | 2000-031721 | 1/2000 |
| JP | 2001024426 | 1/2001 |
| JP | 2000-13126 | 7/2001 |
| JP | 2001-298313 | 10/2001 |
| JP | 2002-141732 | 5/2002 |
| JP | 2002-330025 | 11/2002 |
| JP | 2003-124729 | 4/2003 |

* cited by examiner

*Primary Examiner*—Tho Phan
(74) *Attorney, Agent, or Firm*—Stites & Harbisin PLLC; Ross F. Hunt, Jr.

(57) ABSTRACT

A high frequency antenna module having a substrate, a feeding electrode and two dielectric chip antennas being mounted on said substrate. Each of the two dielectric chip antennas having a base end connected to the feeding electrode and a floating end as an open end. A distance between said open ends of the two dielectric chip antennas is shorter than a distance between said base ends of the two dielectric chip antennas.

15 Claims, 3 Drawing Sheets

HIGH FREQUENCY ANTENNA MODULE

BACKGROUND OF THE INVENTION

1. Field of the Invention

The present invention relates to a high frequency antenna module having two sets of internal antennas corresponding to the same frequency, which is used in a portable telephone or a wireless LAN. Hereinafter, "High frequency" is in a range from 100 MHz to 20 GHz.

2. Description of the Related Art

Some portable wireless communications apparatus for wireless LAN employ a plurality of antennas in a so-called diversity system. Space diversity, pattern diversity, polarization diversity, frequency diversity, and time diversity are examples of the diversity system.

Among others, the space diversity system uses two or more antennas for reception, which are physically separated from each other. Though there is no need for the plurality of antennas, if one antenna is able to transmit and receive electromagnetic wave in all directions, the plurality of antennas are practically mounted. As the antenna in the diversity system of this type, a chip antenna having the radiation electrodes formed on the surface or inside of a base substance is typically employed (refer to patent documents 1, 2 and 3). As the scheme for the dielectric chip antenna, a monopole, an inverted F, and a patch are known. Since the high frequency module built in the portable unit for wireless LAN is strongly required to be smaller, the antenna is also required to be miniaturized. Consequently, the dielectric chip antenna is mounted on a printed board. An antenna module in which a plurality of chip antennas is arranged on the mounting substrate has been known (refer to patent document 4).

[Patent document 1] JP-A-2000-13126

[Patent document 2] JP-A-9-55618

[Patent document 3] JP-A-10-98322

[Patent document 4] JP-A-9-199939

The antenna modules using such chip antenna is satisfactory from a viewpoint of miniaturization for the portable or wireless uses, but does not necessarily meet the antenna characteristics such as the reflection coefficient and the radiation gain. The present inventors have made elaborate researches on the antenna characteristics, which greatly depend on the arrangement and positional relation of two antennas, when two antennas are mounted on one end face of the mounting substrate. Consequently the present inventors have found the optimal arrangement and positional relation of antennas to attain the excellent antenna characteristics.

SUMMARY OF THE INVENTION

It is an object of the invention to provide a high frequency antenna module having an internal antenna for the portable or wireless uses, which meets the requirement of miniaturization and is superior in the antenna characteristics such as the reflection coefficient and the radiation gain.

In order to achieve the above object, according to the first aspect of the invention, there is provided with a high frequency antenna module including a substrate, a feeding electrode and at least two dielectric chip antennas being mounted on said substrate, each of said two dielectric chip antennas having a base end connected to said feeding electrode and a floating end as an open end, wherein a distance between said open ends of said two dielectric chip antennas is shorter than a distance between said base ends of said two dielectric chip antennas.

According to the first aspect of the invention, each of the two dielectric chip antennas configured as one pair of radiation electrodes formed on a dielectric chip and having a pattern in which the base end of each of the dielectric chip antennas is connected to the feeding electrode, and the floating end of each of the dielectric chip antennas is the open end, one of each pair of radiation electrodes corresponding to one frequency, and the other radiation electrode of each pair corresponding to a different frequency from the one frequency, wherein the distance between the open ends of one of each pair of radiation electrodes is shorter than the distance between the base ends thereof.

According to second aspect of the invention, there is provided with the high frequency antenna module according to claim 1, wherein said two dielectric chip antennas are formed on a dielectric chip, wherein each of said two dielectric chip antennas is configured as a pair of radiation electrodes, wherein said radiation electrodes have such a pattern that said both base ends of said two dielectric ship antennas are connected to said feeding electrode, and that said both floating ends are open ends, wherein one of said radiation electrodes is corresponding to one frequency, wherein the other of said radiation electrodes is corresponding to a different frequency from said one frequency, and wherein a distance between said open ends of said radiation electrodes is shorter than a distance between said base ends of said radiation electrodes.

According to the second aspect of the invention, the two antennas formed on the substrate configured as one pair of radiation electrodes having a pattern in which the base end of each antenna is connected to the feeding electrode and the floating end of each antenna is the open end, one of each pair of radiation electrodes corresponding to one frequency, and the other radiation electrode of each pair corresponding to a different frequency from the one frequency, wherein the distance between the open ends of one of each pair of radiation electrodes is shorter than the distance between the base ends thereof.

In the first and second aspects of the invention, inventions, the pattern of radiation electrodes making up each antenna has a meandering shape.

DESCRIPTION OF THE PREFERRED EMBODIMENTS

The preferred embodiments of the present invention will be described below with reference to the accompanying drawings.

Figure 1:
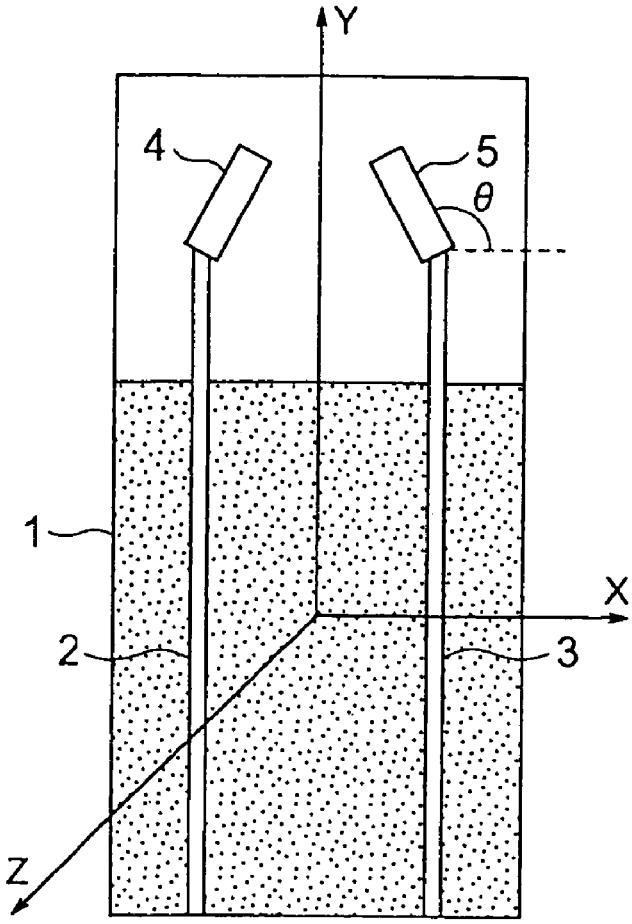
FIG. 1 is a schematic plan view showing the essence of a high frequency antenna module according to one embodiment of the present invention.

FIG. 1 shows a high frequency antenna module according to one embodiment of the invention. In FIG. 1, reference number 1 is a mounting substrate. Two feeding lines 2 and 3 are formed at positions 10 mm away from the lateral edges of the mounting substrate 1. The feeding lines 2 and 3 extend from the lower end the mounting substrate 1 to the upper end of the mounting substrate 1. Two dielectric chip antennas 4 and 5 are mounted in contact with the upper ends of the feeding lines 2 and 3.

Figure 2:
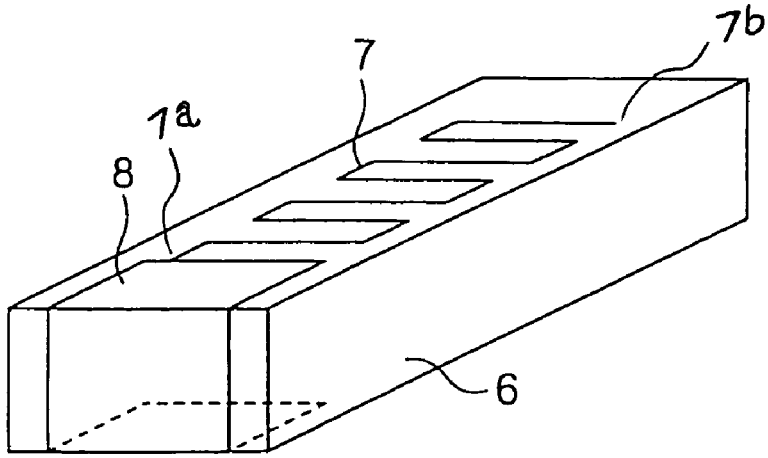
FIG. 2 is a schematic enlarged perspective view showing one example of a dielectric chip antenna for use in the high frequency antenna module of FIG. 1.

Each of the dielectric chip antennas 4 and 5 employs a ./4 antenna favorable for miniaturization. The dielectric chip includes a radiation electrode, which is formed in meandering shape in order to miniaturize its size, while keeping a required line length. That is, the antenna was fabricated by forming a meandering line on a base substance 6 of alumina ceramic (dielectric constant 10) as shown in FIG. 2. A base end 7*a* of a radiation electrode 7 is connected to a feeding electrode 8 formed from one end face of the base substance 6 to the upper and lower faces. A floating end 7*b* of the radiation electrode 7 is an open end. In this manner, the radiation electrode is formed in meandering shape, so that the dielectric chip becomes a rectangular parallelepiped. One end of the dielectric chip is available for feeding, and the other end is an open end. A shape of the dielectric chip is not limited only rectangular parallelepiped. The shape of the dielectric chip may be triangle pole, polyangular pole, column and cone having a bottom surface formed in polygonal shape.

The radiation electrode 7 and the feeding electrode 8 are formed on the surface of the base substrate 6 made of alumina ceramic by printing or depositing gold, silver, copper, or alloy of them as main components using the film forming method such as the screen printing, vapor deposition or plating.

Two dielectric chip antennas 4 and 5 formed are mounted on the mounting substrate 1 in such a way that the feeding electrode 8 is connected to the floating end of two feeding lines 2 and 3, and the distance between the open ends of the two dielectric chip antennas 4 and 5 is shorter than the distance between the base ends, as shown in FIG. 1. A circuit module (not shown) comprising a diplexer, a switching element for duplexer, an amplifier, a low pass filter and a band pass filter is mounted in a portion with matte finish on the two feeding lines 2 and 3 of the mounting substrate 1.

The specific sizes of parts in the high frequency module shown in FIG. 2 are as follows.

Size of mounting substrate 1: 105 mm (length), 46 mm (width)

Size of feeding lines 2, 3: 85 mm (length), 1.7 mm (width)

Size of dielectric base substance: 10 mm (length), 3 mm (width), and 1 mm (thickness)

Figure 3:
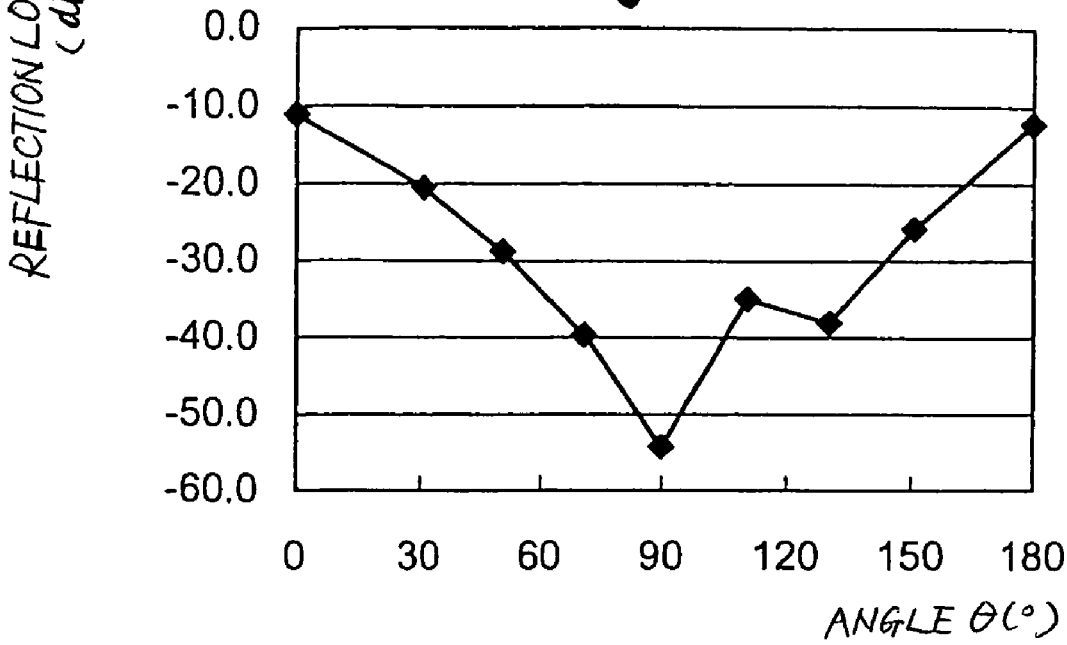
FIG. 3 is a graph showing the relationship between disposition angle and reflection coefficient of the dielectric chip antenna in the high frequency antenna module of FIG. 1.

Size of radiation electrode: 8 mm (length), 0.3 mm (width), line spacing 0.3 mm, folded width 2.5 mm FIG. 3 is a graph showing the relationship between angle . and reflection coefficient in the high frequency antenna module for the high frequency module as shown in FIG. 2. The reflection coefficient is required to be −20 dB as a standard. The angle . is preferably from 30 to 150.

Figure 4:
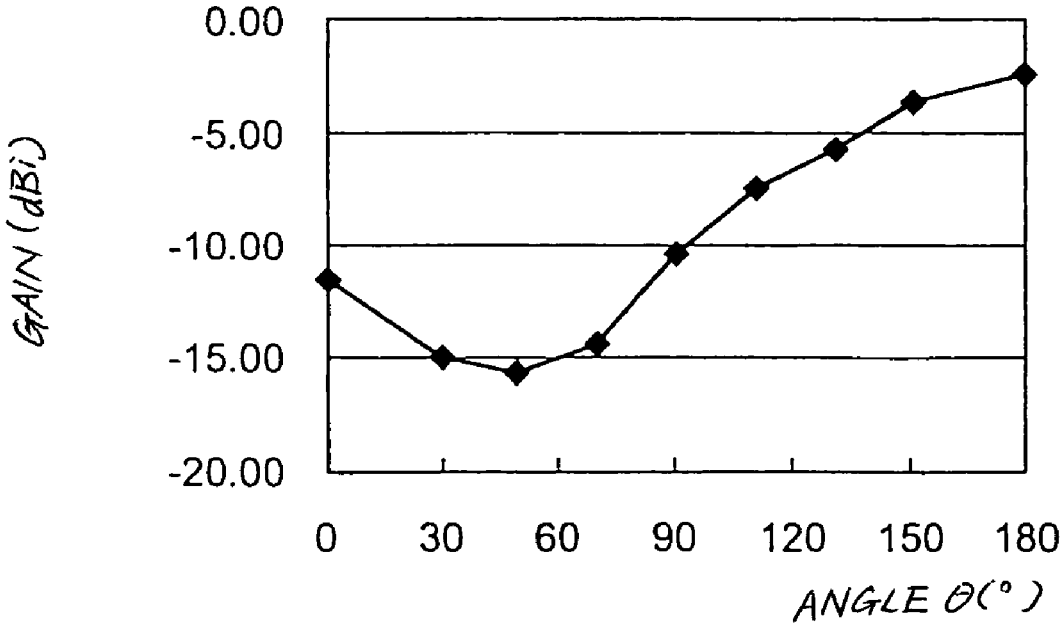
FIG. 4 is a graph showing the relationship between disposition angle and horizontal polarization gain in the Y direction of the dielectric chip antenna in the high frequency antenna module of FIG. 1.

FIG. 4 is a graph showing the relationship between angle and horizontal polarization radiation gain in the Y direction in the high frequency antenna module as shown in FIG. 1. Non-directional characteristic is required in a radiation directivity of the wireless LAN antenna. One criterion for evaluation of the radiation directivity may be the magnitude of the horizontal polarization radiation gain in the Y direction. Table below shows the numerical values.

TABLE 1

| | Angle. (.) | | | | | | | | |
|---|---|---|---|---|---|---|---|---|---|
| | 0 | 30 | 50 | 70 | 90 | 110 | 130 | 150 | 180 |
| Gain (dBi) | −11.67 | −14.99 | −15.66 | −14.35 | −10.41 | −7.62 | −5.81 | −3.68 | −2.47 |

The radiation gain is required to be −10 dBi as a standard. The angle . is preferably from 90 to 180. . Accordingly, it is optimal to select the angle . in a range from 90 to 150. to obtain the preferred results for both the reflection coefficient and the radiation gain.

Figure 5:
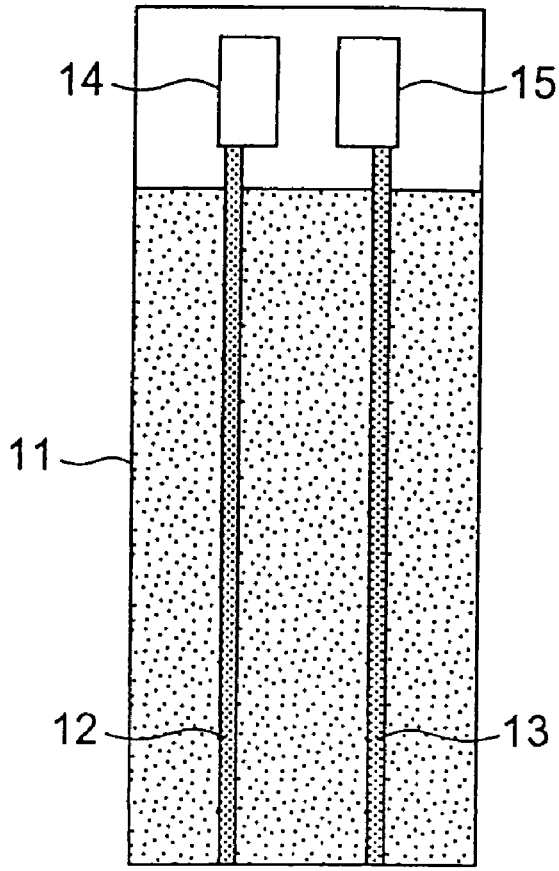
FIG. 5 is a schematic plan view showing the essence of a high frequency antenna module according to another embodiment of the invention.

FIG. 5 shows a high frequency antenna module according to another embodiment of the invention. In FIG. 5, reference number 11 is corresponding to a mounting substrate. Two feeding lines 12 and 13 are formed at positions 10 mm away from both lateral edges of the mounting substrate 11 and extending from the lower end of the mounting substrate 11 to the upper end of the mounting substrate 11. Two dielectric chip antennas 14 and 15 are mounted in contact with the upper ends of the feeding lines 12 and 13.

Figure 6:
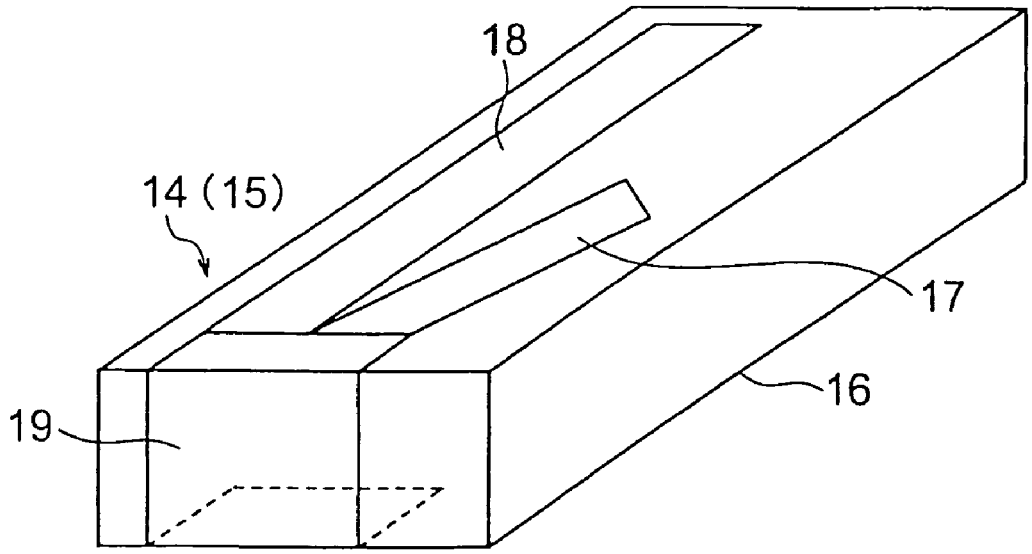
FIG. 6 is a schematic enlarged perspective view showing one example of a dielectric chip antenna for use in the high frequency antenna module of FIG. 5.

In the embodiment as shown in FIG. 5, each of the dielectric chip antennas 14 and 15 is formed with one pair of radiation electrodes consisting of a relatively short radiation electrode 17 corresponding to one frequency and a relatively long radiation electrode 18 corresponding to a different frequency from the one frequency on a base substance 16 made of the same dielectric material as in FIG. 2. One pair of radiation electrodes 17 and 18 is arranged in a V-character pattern at an angle between them from 20. to 40. . That is, the relatively short radiation electrode 17 and the relatively long radiation electrode 18 as one pair have the base ends connected to the feeding electrode 19 formed from one end face of the base substance 16 to the upper and lower faces, and the respective floating ends being the open ends, as shown in FIG. 6. Moreover, one pair of radiation electrodes 17, 18 and the other pair of radiation electrodes 17, 18 are configured in the symmetrical pattern. In this case, the radiation electrodes 17, 18 and the feeding electrode 19 are formed on the surface of the base substance 6 made of alumina ceramic by printing or depositing gold, silver, copper, or alloy of them as main components using the film forming method such as the screen printing, vapor deposition or plating.

Two dielectric chip antennas 14 and 15 formed are mounted on the mounting substrate 11 in such a way that the feeding electrode 19 is connected to the floating ends of two feeding lines 12 and 13, and the distance between the open ends of one radiation electrodes 17 of each pair of radiation electrodes for the dielectric chip antennas 14 and 15 is shorter than the distance between the base ends, as shown in FIG. 6. A circuit module (not shown) comprising a diplexer, a switching element for duplexer, an amplifier, a low pass filter and a band pass filter is mounted in a portion with matte finish on the two feeding lines 12 and 13 of the mounting substrate 11.

The specific sizes of parts in the high frequency dual band antenna module shown in the figure as constituted in the above manner are as follows.

Size of mounting substrate 11: 105 mm length, 80 mm width, and 1.0 mm thickness Size of feeding line 2, 3: 85 mm length, 1.7 mm width Size of dielectric base substance: 15 mm length, 10 mm width, and 1 mm thickness Size of radiation electrode 17: 13 mm length, line width 0.3 mm, line spacing 0.3 mm, folded width 2.5 mm Size of radiation electrode 18: 8 mm length, line width 0.3 mm, line spacing 0.3 mm, folded width 2.5 mm With the high frequency dual band antenna module according to the embodiment as shown in FIG. 5, the almost same antenna characteristics as in FIG. 1 were obtained.

In the embodiment as shown in FIG. 5, of each pair of radiation electrodes 17 and 18, the longer radiation electrode 18 is disposed in parallel to the feeding lines 12 and 13. However, this parallel array is not essential, but it is only necessary that an open end of the shorter radiation electrode 17 is located between the extensions of the feeding lines 12 and 13.

In the shown embodiment, the dielectric chips 4, 5 or 14, 15 are mounted on the mounting substrate 1 or 11, but antenna having the radiation electrode formed in meandering shape may be directly mounted on the mounting substrate. In this case, the antenna having the radiation electrode formed in meandering shape is formed on the surface of the mounting substrate 1 or 11 by printing or depositing using the film forming method such as the screen printing, vapor deposition or plating. Two antennas having the radiation electrode formed in meandering shape should be positioned such that the distance between the open ends of the antenna is naturally narrower than the distance between the feeding ends.

In this case, the size of the antenna portion is greater than when using the dielectric chip antenna.

As described above, according to the first invention, there is provided with a high frequency antenna module having a substrate, a feeding electrode and two dielectric chip antennas being mounted on said substrate, each of said two dielectric chip antennas having a base end connected to said feeding electrode and a floating end as an open end, wherein a distance between said open ends of said two dielectric chip antennas is shorter than a distance between said base ends of said two dielectric chip antennas. Therefore, the antenna module is miniaturized, and provides the preferable antenna characteristics in respect of both the reflection coefficient and the radiation gain.

According to the second invention, there is provided with the high frequency antenna module according to claim 1, wherein said two dielectric chip antennas are formed on a dielectric chip, wherein each of said two dielectric chip antennas is configured as a pair of radiation electrodes, wherein said radiation electrodes have such a pattern that said both base ends of said two dielectric ship antennas are connected to said feeding electrode, and that said both floating ends are open ends, wherein one of said radiation electrodes is corresponding to one frequency, wherein the other of said radiation electrodes is corresponding to a different frequency from said one frequency, and wherein a distance between said open ends of said radiation electrodes is shorter than a distance between said base ends of said radiation electrodes. Therefore, the antenna is miniaturized, and provides the preferable antenna characteristics in respect of both the reflection coefficient and the radiation gain.

Moreover, two dielectric chip antenna main bodies or two antennas formed on a substrate may consist of one pair of radiation electrodes having a pattern in which a base end of each antenna is connected to a feeding electrode, and a floating end of each antenna is an open end, one of each pair of radiation electrodes corresponding to one frequency, and the other radiation electrode of each pair corresponding to a different frequency from the one frequency, wherein the distance between the open ends of one of each pair of radiation electrodes is made shorter than the distance between the base ends thereof. In this case, a dual band is dealt with because the preferable antenna characteristics to cope with the dual band, and the requirement of miniaturization are satisfied.

What is claimed is:

1. A high frequency antenna module, comprising:

a substrate;

first and second feeding lines; and first and second dielectric chip antennas of the same frequency, each of said chip antennas comprising a $\lambda/4$ antenna formed by a respective dielectric chip, each said chip including a feeding electrode and a radiation electrode;

wherein;

said first and second dielectric chip antennas are each mounted on said substrate with the associated feeding electrode connected to a respective feeding line of the first and second feeding lines;

each said radiation electrode has a base end connected to the associated feeding electrode and a floating end forming an open end of the corresponding dielectric chip antenna; and a distance between the open ends of the dielectric chip antennas is shorter than a distance between said base ends.

2. The high frequency antenna module according to claim 1, wherein:

each of said two dielectric chip antennas comprises a pair of said radiation electrodes, each said pair of radiation electrodes is arranged so that both base ends of said pair of radiation electrodes are connected to said feeding electrode, and so that both floating ends of said radiation electrodes are open ends, one of said radiation electrodes corresponds to one frequency, the other of said radiation electrodes corresponds to a different frequency from said one frequency, and a distance between the open end of a first radiation electrode of said one pair of radiation electrodes and the open end of the corresponding radiation electrode of the other pair of radiation electrodes is shorter than a distance between said base ends of said first radiation electrode and said corresponding radiation electrode.

3. The high frequency antenna module according to claim 2, wherein said radiation electrode have a meandering shape.

4. The high frequency antenna module according to claim 2, wherein:

the one of said radiation electrodes is longer than the other of said radiation electrodes, the one of said radiation electrodes is disposed in parallel with the corresponding feeding line, and the open end of the other of said radiation electrode is located between extension lines of the feeding lines.

5. The high frequency antenna module according to claim 1, wherein said radiation electrode have a meandering shape.

6. The high frequency antenna module according to claim 5, wherein said two dielectric chip antennas are formed in a rectangular parallelepiped shape.

7. In combination, a substrate and a circuit module mounted on the substrate, said circuit module comprising:

first and second feeding lines; and first and second antennas of the same frequency and comprising a radiation electrode forming a λ/4 internal antenna used for a portable or wireless application, said antennas being mounted on the substrate, each in contact with a respective one of said feeding lines, wherein:

each said radiation electrode has a base end connected to a feeding electrode and a floating end forming an open end of the antenna, a distance between said open ends of said two antennas is shorter than a distance between said base ends, and said radiation electrodes have a meandering shape.

8. The combination as claimed in claim 7 claim wherein said circuit module comprises a duplexer.

9. The combination as claimed in claim 7 claim wherein said circuit module comprises a switching element for a duplexer.

10. The combination as claimed in claim 7 claim wherein said circuit module comprises an amplifier.

11. The combination as claimed in claim 7 claim wherein said circuit module comprises a low pass filter.

12. The combination as claimed in claim 7 claim wherein said circuit module comprises a band pass filter.

13. A high frequency antenna module, comprising:

a substrate;

first and second feeding lines; and first and second antennas of the same frequency and comprising a radiation electrode forming a λ/4 internal antenna used for a portable or wireless application, said antennas being mounted on the substrate, each in contact with a respective one of said feeding lines, wherein:

each said radiation electrode has a base end connected to a feeding electrode and a floating end forming an open end of the antenna, and a distance between said open ends of said two antennas is shorter than a distance between said base ends, each of said two antennas comprising a pair of said radiation electrodes, each said pair of radiation electrodes being arranged so that both base ends of said pair of radiation electrodes are connected to said feeding electrode, and so that said floating ends of said radiation electrodes forms open ends, one of said pair of radiation electrodes corresponding to a different frequency from said one frequency, and a distance between the open end of a radiation electrode of the one pair and the open end of the corresponding radiation electrode of the other pair being shorter than a distance between said base ends of said corresponding radiation electrodes.

14. The high frequency antenna module according to claim 13, wherein said radiation electrodes have a meandering shape.

15. The high frequency antenna module according to claim 13, wherein:

the one of said radiation electrodes is longer than the other of said radiation electrodes, the one of said radiation electrodes is disposed in parallel with the corresponding feeding line, and the open end of the other of said radiation electrode is located between extension lines of the feeding lines.

* * * * *